US006286432B1

(12) United States Patent
Reider

(10) Patent No.: US 6,286,432 B1
(45) **Date of Patent: *Sep. 11, 2001**

(54) BAYONET PRIMER

(75) Inventor: John L. Reider, Edina, MN (US)

(73) Assignee: Alliant Techsystems Inc., Hopkins, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/386,704

(22) Filed: Aug. 31, 1999

(51) Int. Cl.[7] ..... F42B 5/26; C06C 7/00; F42C 19/10

(52) U.S. Cl. ..... 102/470; 102/469; 102/202; 102/204

(58) Field of Search ..... 102/202, 204, 102/430–434, 439, 469, 470

(56) References Cited

U.S. PATENT DOCUMENTS

| | | | |
|---|---|---|---|
| 1,491,676 | 8/1924 | Courouble . | |
| 3,182,595 | 5/1965 | Hassmann . | |
| 5,052,302 | 10/1991 | Taddeo | 102/204 |
| 5,465,665 | 11/1995 | Diehl | 102/470 |
| 5,831,204 | 11/1998 | Lubben | 102/318 |
| 5,895,881 | 4/1999 | Thiesen | 102/202 |

OTHER PUBLICATIONS

Bourgeois and Blackett, High–Density Polyethylenes(H-DPE), 1988, vol. Engineered Materials Handbook, ASM International, pp. 163–166.

*Primary Examiner*—Charles T. Jordan
*Assistant Examiner*—Kimberly Smith
(74) *Attorney, Agent, or Firm*—George A. Leone

(57) ABSTRACT

A primer assembly includes a head loading assembly including a frontward throughbore, and a rearward throughbore having a stop. A closing plug assembly includes a conically bored open frontward end and an open cylindrical rearward end including an outer flange between the frontward and rearward ends. The closing plug assembly is press fitted into the head loading assembly frontward throughbore. An ignition element assembly is press fitted into the head loading assembly rearward throughbore. The ignition element assembly has an ignition element portion that bears against the stop. The closing plug assembly and the ignition element are located to be captivated by threading a flashtube into a head loading assembly threaded portion.

20 Claims, 5 Drawing Sheets

BAYONET PRIMER

CROSS REFERENCE TO RELATED APPLICATION

The present patent application is related to U.S. patent application No. 09/386,810, to Reider, entitled "PLASTIC LINER FOR BAYONET PRIMERS," filed on Aug. 31, 1999 and assigned to the assignee of this application. The aforesaid U.S. patent application No. 09/386,810 is hereby incorporated by reference.

FIELD OF THE INVENTION

The present invention relates generally to bayonet primer devices, and more particularly to a bayonet primer used in tank ammunition, where the bayonet primer has a press-fit interlocking head assembly.

BACKGROUND OF THE INVENTION

Bayonet primers have long been used in tank ammunition. As noted in U.S. Pat. No. 5,465,665 to Diehl issued Nov. 14, 1995, entitled "Primer," a typical bayonet type primer includes a primer head for housing an initial firing stage of a round. An ignition element, pressed into place in the confines of the primer head, is charged with a pyrotechnic composition that starts the firing train. When activated, the ignition element disperses a flame through a retainer. The flame sets off an explosive charge of black powder. The black powder charge in turn propagates through a closing plug which acts as a directional device to a third charge of Benite. Benite is comprised mainly of nitrocellulose and black powder in a stranded form and other pyrotechnic formulations, housed in the primer body. The third charge propagates through holes in the metal primer body initially sealed with a lacquer. This charge, propagating through the primer body, ignites the propelling charge contained in the ammunition case moving the ammunition projectile such as a penetrator out of the gun barrel and to its target. U.S. Pat. No. 5,465,665 is incorporated in its entirety herein by reference.

Unfortunately, conventional primers require a fine thread for attaching a retaining ring and closing plug assembly into a primer head assembly. Use of such a fine thread attachment mechanism results in a complicated and cumbersome assembly procedure. During assembly, the retaining ring must initially be carefully aligned. Once aligned it must be threaded into the head assembly without cross threading, driven to a specified torque value, and then staked. Such a delicate process is very difficult to automate due to the tolerances involved.

The threads are coated with a lacquer to secure the threaded parts. Such use of lacquer for securing the thread closing plug assembly presents a process variable that is difficult to control in automated assembly environments. As is the case with the retaining ring, sensitive alignment, cross-threading and torque controls are required. As a further drawback of conventional primers, fine threads often gall and bind during the assembly, thus adding another failure mode in an assembly already prone to difficult processes.

In conventional primers, the load of a potential shock is born by the fine internal threads of the retaining ring holding in the press fit ignition element assembly. In such old configurations, the lacquer may fail to secure the parts, and the closing plug assembly can unscrew due to such shocks. A visual inspection of the primer tube would not show an external indication of a problem with such an unthreaded closing plug assembly.

For many years, typical prior art designs have included the threaded retaining ring juxtaposed between the closing plug assembly and the ignition element. Such retaining rings provided a mechanism for sealing parts. Retaining rings of prior art primers also formed a gap between the closing plug assembly and ignition element. The gap was thought necessary for the proper ignition of black powder held by the closing plug assembly.

In contrast to the prior art, it has been discovered that the black powder used in the closing plug assembly is not very sensitive to the configuration of the ignition mechanism. It has further been discovered that neither the gap provided by the retaining ring, nor the retaining ring itself, significantly effect the function of the primer ignition. The present invention takes advantage of these discoveries by providing an improved and simplified primer redesigned to eliminate the retaining ring and gap. The simplified primer of the present invention generates significant savings in manufacture by eliminating hard-to-handle small parts, complicated automated handling systems, difficult inspections, and scrap without significantly effecting primer ignition times.

Further in contrast to the prior art, a primer constructed in accordance with the present invention exhibits significant gains in safety because it can be ascertained that all parts are assembled correctly from a visual inspection of the exterior of a fully assembled primer. Further still, the primer of the present invention is less costly to manufacture due to the elimination of parts used in the prior art that are difficult to handle and assemble. Elimination of parts also reduces the administrative efforts of procurement, inspection, inventory, storage, scheduling and scrap. Further still, the present invention substantially reduces continuous maintenance of complicated and temperamental assembly machinery.

SUMMARY OF THE INVENTION

In contrast to the prior art, the present invention provides a primer assembly including a head loading assembly with a frontward throughbore having a threaded portion, and a rearward throughbore having a stop. A closing plug assembly including a conically bored open frontward end and an open cylindrical rearward end including an outer flange between the frontward and rearward ends, is press fitted into the head loading assembly frontward throughbore. An ignition element assembly is press fitted into the head loading assembly rearward throughbore. The ignition element assembly has an ignition element portion that bears against a stop of the rearward throughbore. The closing plug assembly and the ignition element are located to be captivated by threading a flashtube into the threaded portion.

In one aspect, the present invention provides a primer having a lengthened losing plug assembly that fits snugly against an ignition element assembly when pressed into a head loading assembly while eliminating spacers and a seal.

As a further advantage, the primer of the present invention provides a head loading assembly where the closing plug assembly and the head loading assembly are press fit, and where the closing plug assembly includes an interlocking flange for mechanical interlock of internal parts.

As a further advantage, a primer constructed in accordance with the present invention transfers the loads of impact and vibration to heavier flashtube assembly threads, and not internal threads of the ignition element assembly as was typical of the prior art configurations.

In bayonet primers made in accordance with the prior art, one or more brass discs were placed above the ignition element and retained by the retaining ring. As a further advantage, and in contrast to the prior art, the present invention provides a bayonet primer that eliminates the need for such brass discs without any detectable performance impact.

As a further advantage, a primer of the present invention allows a length measurement of the primer assembly to verify correct assembly.

Other objects, features and advantages of the invention will become apparent to those skilled in the art through the description of the preferred embodiment, claims and drawings herein wherein like numerals refer to like elements.

DETAILED DESCRIPTION OF THE INVENTION

Figure 1:
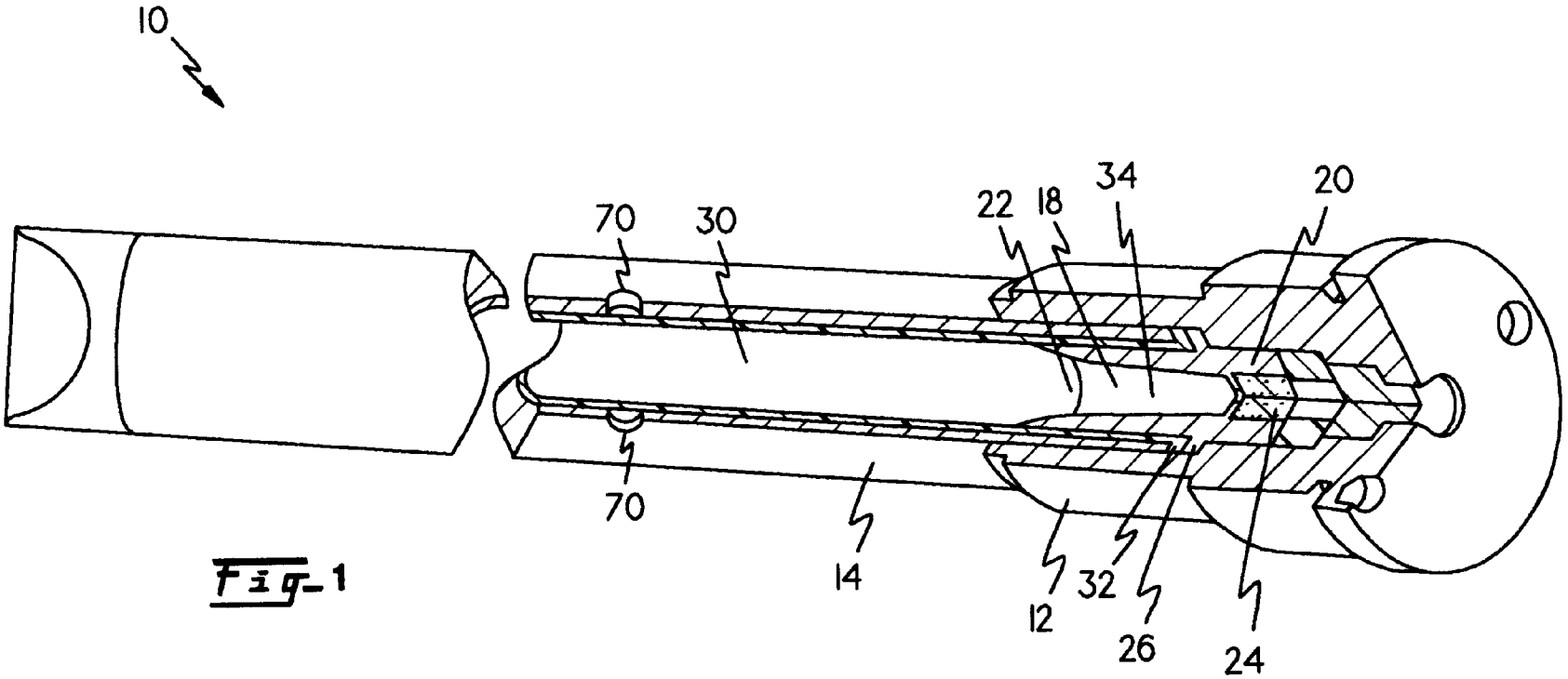
FIG. 1 is a partial cut-away perspective view of one example of a bayonet primer including one example of an interlocking and press fit head loading assembly as contemplated by the present invention.

FIG. 1 is a partial cut-away perspective view of one example of a bayonet primer including a plastic liner as contemplated by the present invention. The primer assembly 10 includes a head loading assembly 12, and a flashtube 14. An open rearward end 18 of the flashtube 14 is connected to the head loading assembly 12 located rearwardly of the flashtube. A closing plug assembly 20 includes a conically bored open frontward end 22 and an open cylindrical rearward end 24 including an outer flange 26 between the frontward and rearward ends. The closing plug assembly 20 is attached to the head loading assembly 12. The flashtube includes a plurality of holes 70 disposed along the length of the flashtube. In one example, an extruded plastic flashtube liner is affixed within the flashtube so as to seal the holes.

A flashtube liner 30 has a flange 32 at an open rearward end 34. The flashtube liner 30 is inserted into the flashtube 14 so as to line the inner wall of the flashtube 14. In one embodiment of the invention, the flashtube liner 30 is held in place by the flashtube 14 impinging the flashtube liner flange 32 between the closing plug assembly outer flange 26 and the open rearward end 18 of the flashtube. To complete the primer assembly 10, the flashtube liner is loaded with a charge of Benite 60, substantially comprising nitrocellulose and black powder in a stranded medium (best shown in FIG. 4). The rearward end 18 of the flashtube is threaded into the head loading assembly 12 to a depth defined by the flashtube liner disposed between the closing plug assembly outer flange 26 and the open rearward end 18 of the flashtube.

Figure 2:
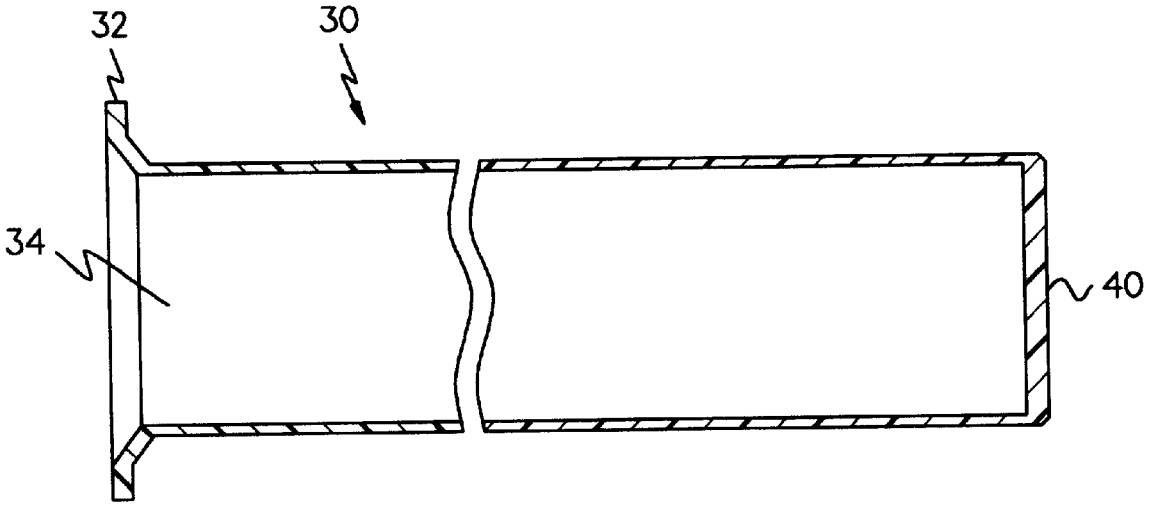
FIG. 2 is a cross-sectional view of one example of a plastic liner tube assembly as contemplated in a preferred embodiment of the present invention.

Referring now to FIG. 2, a cross-sectional view of one example of a plastic liner tube assembly as contemplated by the present invention is shown. The flashtube liner 30 is an extruded plastic tube having a flange 32 and an open rearward end 34 and a closed forward end 40.

In a preferred embodiment of the invention, the flashtube liner is comprised substantially of an extruded plastic material. In a more preferred embodiment of the invention, the extruded plastic material comprises an extruded high density polyethylene material. It has been found that the high density polyethylene material works well for constructing a flashtube liner having a length greater than 2 inches.

In some prototype devices, the material chosen for the plastic in these parts was polyethylene. This material had been prior approved for use in contact with explosives, and was also used to make milk/water jugs, tanks and containers for storing alcohol and acetone for extended periods of time to prevent moisture contamination of the contents. Nearly any plastic that has melt characteristics acceptable to the end use storage requirements can be used.

Figure 3:
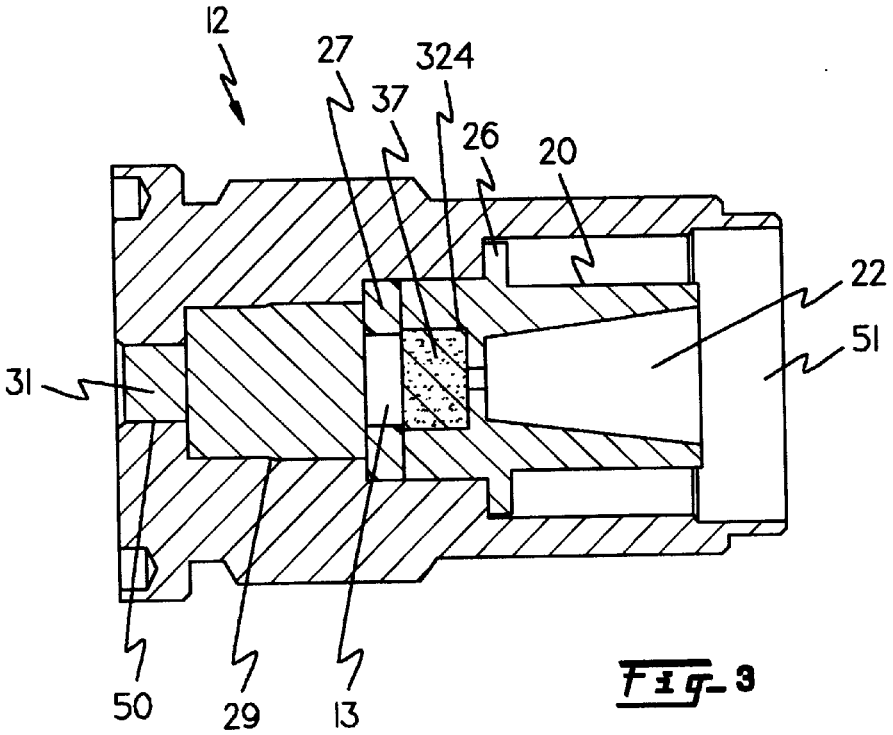
FIG. 3 is a cross-sectional view of an alternate example of an interlocking and press fit head loading assembly as contemplated by the present invention.

FIG. 3 is a cross-sectional view of an alternate head loading assembly 12 including a closing plug assembly 20 and an ignition element 29. The head loading assembly 12 includes a frontward throughbore 51. The closing plug assembly is attached within the frontward throughbore 51. The head loading assembly 12 includes a rearward throughbore 50. An ignition element 29 is attached within the rearward throughbore 50. When activated, the ignition element 29 is in communication with the black powder contained in the closing plug assembly. The ignition element 29 includes a conventional electrode 31. The closing plug assembly 20 includes a conically bored open frontward end 22 and an open cylindrical rearward end 324 including an outer flange 26 between the frontward and rearward ends. The closing plug assembly rearward end 324 contains black powder 37. In some embodiments, at least one spacer 27 may be juxtaposed between the closing plug assembly and the ignition element, leaving a gap 13. The closing plug assembly 20 is attached to the head loading assembly 12 by press fitting the closing plug assembly into the frontward throughbore 51.

Figure 4:
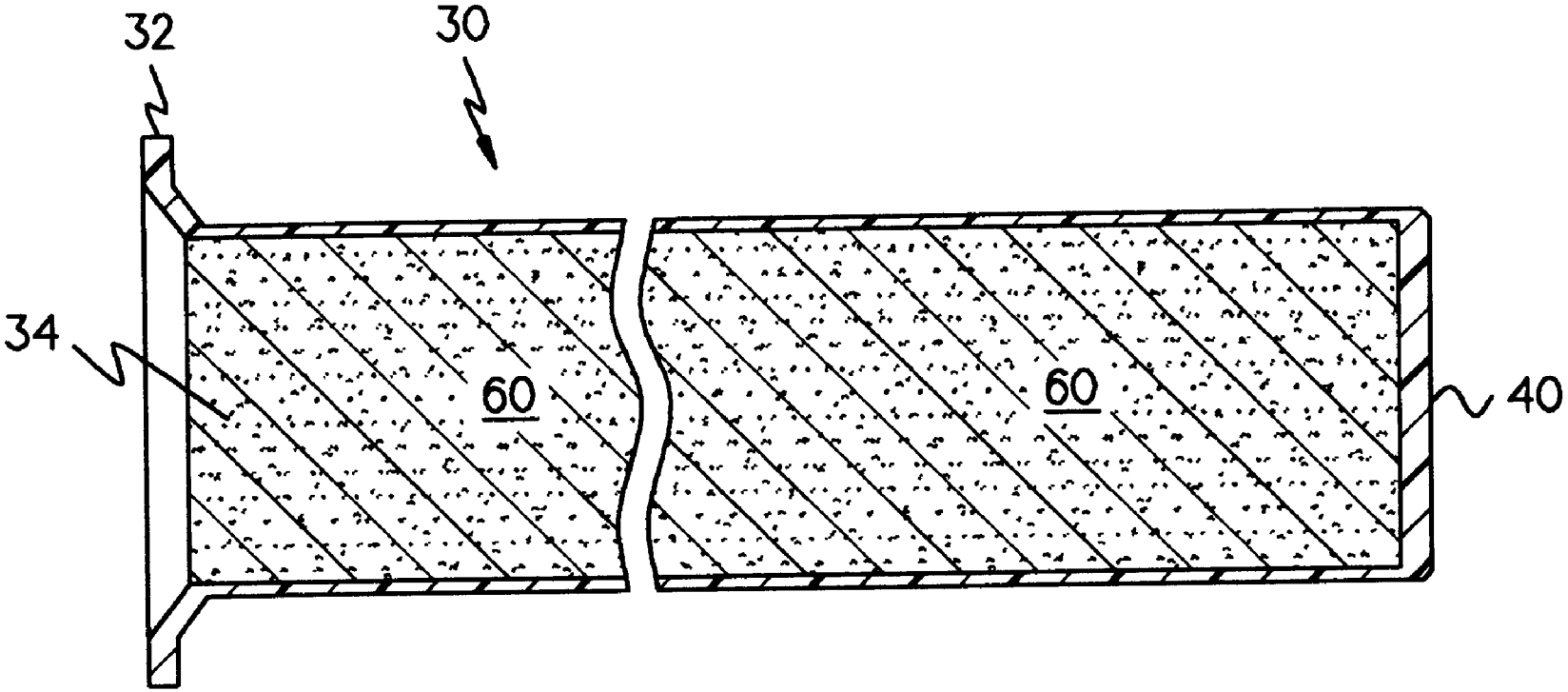
FIG. 4 is a cross-sectional view of one example of a plastic liner tube assembly loaded with Benite as contemplated in a preferred embodiment of the present invention.

Referring now to FIG. 4, a cross-sectional view of a plastic liner tube assembly loaded with Benite 60 as contemplated by the present invention is shown. The Benite 60 may be loaded before inserting the liner into the flashtube.

Figure 5:
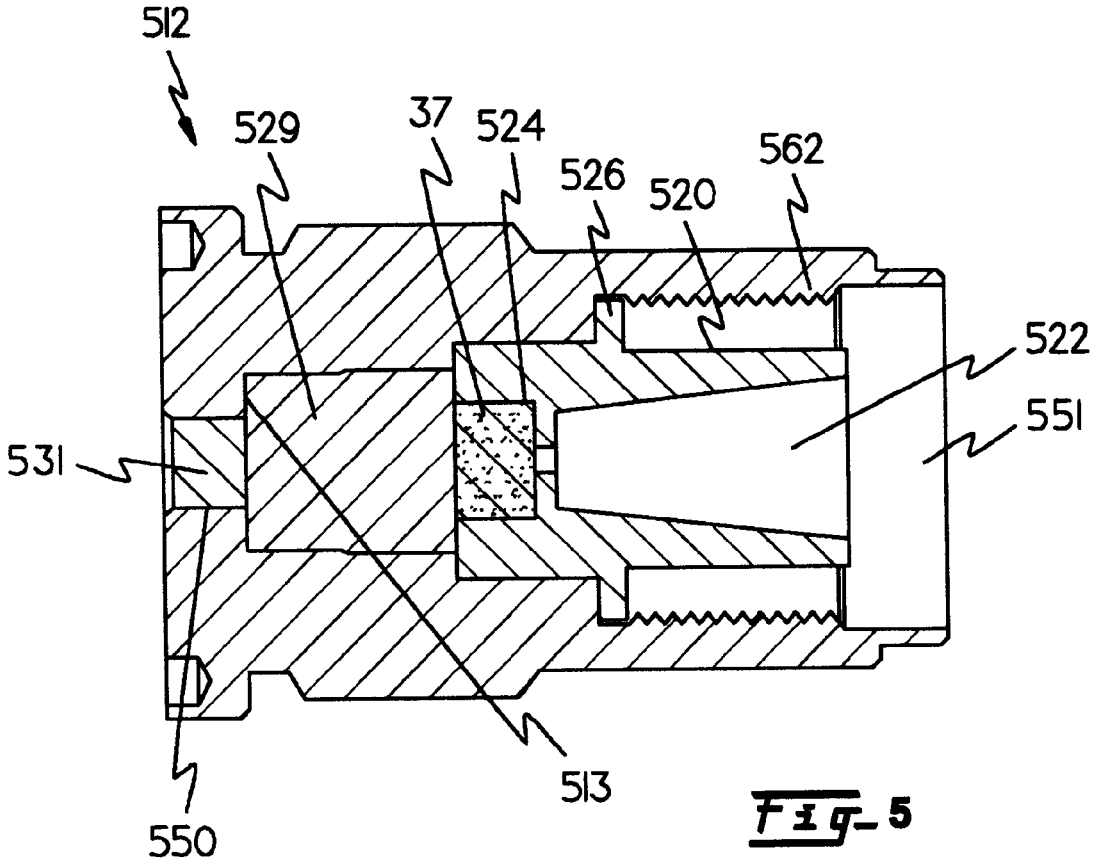
FIG. 5 is a cross-sectional view of an example embodiment of one example of an interlocking and press fit head loading assembly as contemplated by the present invention.

FIG. 5 is a cross-sectional view of an example embodiment of an interlocking and press fit head loading assembly 512 including a lengthened closing plug assembly 520 and an ignition element 529 as contemplated by the present invention. Note that, in contrast to the configuration of FIG. 3, the lengthened closing plug assembly 520 eliminates the need for spacers. The head loading assembly 512 includes a frontward throughbore 551. The closing plug assembly is press fitted within the frontward throughbore 551. The closing plug assembly 520 includes a conically bored open frontward end 522 and an open cylindrical rearward end 524 including an outer flange 526 between the frontward and rearward ends. The closing plug assembly rearward end 524 contains black powder 37. The black powder 37 may conventionally be held in place by a paper liner (not shown). The head loading assembly 512 includes a rearward throughbore 550.

The ignition element 529 is attached within the rearward throughbore 550 pressed against the closing plug assembly rearward end enclosing black powder 37. The ignition element 529 includes a conventional electrode 531. The closing plug assembly 520 is sized to be press fit into the frontward throughbore 551. The ignition element assembly 529 is configured to be press fit into the rearward throughbore 550, bearing against stop 513. The head loading assembly 512 also includes threads 562 for threadedly attaching the flashtube 14.

Figure 6:
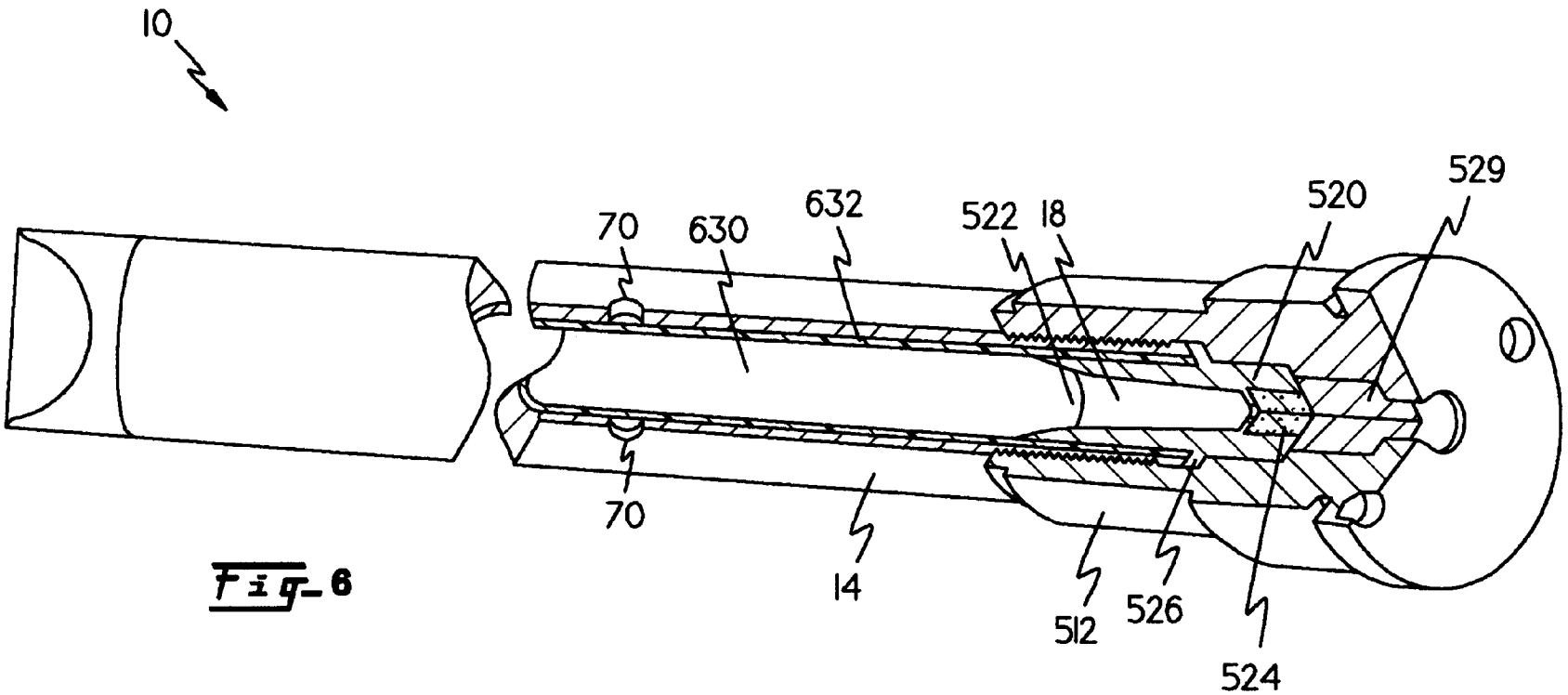
FIG. 6 shows an alternate embodiment of a bayonet primer of the invention having a conventional paper liner with a conventional lacquer coating.

Now referring to FIG. 6, an alternate embodiment of the invention is shown. In the alternative embodiment, the plastic flashtube liner is replaced by a conventional paper liner 630 with a conventional lacquer coating 632. In the case of the alternative embodiment, the liner does not include a flange. Otherwise, the assembly is substantially the same as described hereinabove with respect to FIG. 1.

Referring now jointly to FIG. 1 and FIG. 6, once the flashtube 14 is attached to the threaded portion of the head loading assembly, the interior parts including the flashtube liner 30 or 630, head loading assembly 12 or 512 with the closing plug assembly 20 or 520 and the ignition element assembly 529, are held in place. Specifically, the flashtube 14 is threaded onto the head loading assembly 12 or 512, depending upon the embodiment used. The closing plug assembly 20 or 520, as the case may be, includes an outer flange 26 or 526. The flashtube liner 30 or 630 is sandwiched between the outer flange 26 or 526 and a threaded portion of the flashtube 14.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different materials and structural configurations, and that various modifications, both as to materials and structural configurations and operating procedures, may be accomplished without departing from the true spirit and scope of the present invention.

The embodiments of an invention in which an exclusive property or right is claimed are defined as follows:

1. A primer assembly comprising:

a) a head loading assembly having a frontward throughbore including a threaded portion, and a rearward throughbore including a stop;

b) a flashtube with an open rearward end connected to said head loading assembly;

c) a closing plug assembly including an open frontward end and an open rearward end, and including an outer flange, said closing plug assembly being press fitted into said head loading assembly frontward throughbore, located rearwardly of said flashtube;

d) a flashtube liner containing a charge, the flashtube liner having a flange at an open rearward end, said flashtube liner inserted into said flashtube so as to line the inner wall of said flashtube, wherein said flashtube liner is held in place by said flashtube impinging said flashtube liner flange between said closing plug assembly flange and said open rearward end of said flashtube, wherein said flashtube liner is comprised of an extruded plastic material; and e) an ignition element assembly press fitted into said head loading assembly rearward throughbore, having an ignition element portion that bears against said stop, wherein said flashtube liner, said closing plug assembly and said ignition element are held in place by threading said flashtube into said frontward throughbore threaded portion.

2. The primer assembly of claim 1 wherein said flashtube liner is loaded with a charge including black powder in a stranded medium and said ignition element assembly is held in contact with said closing plug assembly.

3. The primer assembly of claim 2 wherein said head loading assembly further includes a spacer forming a gap between said closing plug assembly and said ignition element.

4. The primer assembly of claim 1 wherein said flashtube liner is loaded with a charge including black powder in a stranded medium.

5. The primer assembly of claim 1 wherein said closing plug assembly rearward end contains black powder.

6. A primer assembly comprising:

a) a head loading assembly having a frontward throughbore including a threaded portion, and a rearward throughbore including a stop;

b) a flashtube containing an ignition charge, an open rearward end of said flashtube connected to said head loading assembly;

c) a closing plug assembly including a conically bored open frontward end and an open cylindrical rearward end including an outer flange between said frontward and rearward ends, said closing plug assembly being press fitted into said head loading assembly frontward throughbore located rearwardly of said flashtube; and d) an ignition element assembly press fitted into said head loading assembly rearward throughbore, having an ignition element portion that bears against said stop, wherein said closing plug assembly and said ignition element are held in place by threading said flashtube into said frontward throughbore threaded portion.

7. The primer assembly of claim 6 wherein said ignition charge is contained in a flashtube liner loaded with a charge including black powder in a stranded medium land said ignition element assembly is held in contact with said closing plug assembly.

8. The primer assembly of claim 6 wherein said head loading assembly further includes a spacer forming a gap between said closing plug assembly and said ignition element.

9. The primer assembly of claim 8 wherein said flashtube liner is loaded with a charge including black powder in a stranded medium.

10. The primer assembly of claim 6 wherein said closing plug assembly rearward end contains black powder.

11. The improved primer assembly of claim 7 wherein said flashtube liner comprises a high density polyethylene material.

12. The improved primer assembly of claim 11 wherein said flashtube liner is loaded with charge including black powder in a stranded medium.

13. The improved primer assembly of claim 7 wherein said flashtube liner comprises a paper material.

14. The improved primer assembly of claim 13 wherein said flashtube liner is loaded with charge including black powder in a stranded medium.

15. The primer assembly of claim 14 wherein said rearward end of said flashtube is threaded into said head loading assembly to a depth defined by said flashtube liner disposed between said closing plug assembly flange and said open rearward end of said flashtube.

16. A head loading assembly for a bayonet primer, the head loading assembly comprising:

a) a frontward throughbore including a threaded portion, and a rearward throughbore including a stop;

b) a closing plug assembly including an open frontward end and an open rearward end including an outer flange, said closing plug assembly press fitted into said head loading assembly frontward throughbore; and c) an ignition element assembly press fitted into said head loading assembly rearward throughbore, having an ignition element portion that bears against said stop of said rearward throughbore, wherein said closing plug assembly and said ignition element are located to be captivated by threading a flashtube into said frontward throughbore threaded portion.

17. The primer assembly of claim 16 wherein said closing plug assembly rearward end contains black powder.

18. The primer assembly of claim 16 wherein said ignition element has a forward portion pressed against said closing plug assembly rearward end.

19. The primer assembly of claim 10 wherein said ignition element has aforward portion pressed against said closing plug assembly rearward end.

20. The primer assembly of claim 5 wherein said ignition element has a forward portion pressed against said closing plug assembly rearward end.

* * * * *